US005225804A

United States Patent [19]

Silbelus

[11] Patent Number: 5,225,804

[45] Date of Patent: Jul. 6, 1993

[54] TREADMILL FOOT-CONTROL FOR ELECTRONIC GAUGING OF CLASSROOM SATISFACTION

[76] Inventor: Daniel D. Silbelus, 244 Lawrence St., New Haven, Conn. 06511-2419

[21] Appl. No.: 769,060

[22] Filed: Sep. 30, 1991

[51] Int. Cl.[5] ..... H01C 10/10

[52] U.S. Cl. ..... 338/153; 338/108

[58] Field of Search ..... 338/153, 108; 272/132, 272/134, 129, 133

[56] References Cited

U.S. PATENT DOCUMENTS 3,711,812 1/1973 Cherry ..... 338/200

4,939,501 2/1990 Weil ..... 338/153

5,062,632 11/1991 Dalebout et al. ..... 272/129

*Primary Examiner*—Marvin M. Lateef

[57] ABSTRACT

A belted-roller treadmill may be modified to serve as a potentiometer whose variable potential may be controlled by sliding the treadmill's belt (10) back and forth with one's foot. The exposed surfaces of the belt would be flush with the exposed surface of a classroom floor (190). An array of such treadmills may be connected to computer hardware for real-time acquisition of data so that an instructor may gauge his students' satisfaction with his instruction in real time.

3 Claims, 6 Drawing Sheets

TREADMILL FOOT-CONTROL FOR ELECTRONIC GAUGING OF CLASSROOM SATISFACTION

BACKGROUND

1. Field of Invention

This invention-hereafter referred to as the invention-relates to systems for electronic gauging of classroom satisfaction, specifically to treadmill foot-controls for inputting data into these systems.

2. Description of Prior Art

U.S. Pat. No. 4,939,501 to weil (1990) and the invention may be used for the same purposes. However, the invention is better protected from damage due to moisture.

An instructor could use the invention to gauge-continuously and conveniently-his students' instantaneous, simultaneous satisfaction with his instruction.

OBJECTS

Accordingly, several objects of the invention are:

(a) to enable an instructor to discern whether his students understand his instruction as he gives it-not only after he finishes expressing one or more ideas;

(b) to enable an instructor to discern whether all his students understand his instruction as he gives it-not just whether one or two understand;

(c) to enable an instructor to discern whether all his students understand his instruction as he gives it throughout an entire lecture-not only in discrete intervals of a couple of seconds or more; and (d) to enable and instructor to gauge his students' satisfaction with his instruction in the manner described in (a) through (c) with minimum inconvenience for anyone-instructor, student, or janitor.

A practical way to satisfy objects (a) through (d) may become apparent by considering the rest of this application.

DRAWING FIGURES

In the drawings, closely related figures have the same number but different alphabetic suffixes.

FIGS. 1A through 1D, when placed adjacent to one another, constitute an exploded view of an embodiment-hereafter referred to as the embodiment-of the entire invention.

REFERENCE NUMERALS IN DRAWINGS

| | |
|---|---|
| 10 belt | 12 outer layer of belt |
| 14 inner layer of belt | 16 drum |
| 18 drum | 20 clamp |
| 22 trench | 24 bolts |
| 26 lock washers | 28 through-holes |
| 30 tapped holes | 32 clamp |
| 34 side plate | 36 side plate |
| 38 nose | 40 nose |
| 42 roller bearing | 44 axil |
| 46 tapped hole | 48 side plate |
| 50 side plate | 52 nose |
| 54 roller bearing | 56 axil |
| 58 tapped holes | 60 tapped hole |
| 62 nut | 64 lock washer |
| 66 through-hole | 68 bracket |

-continued

| | |
|---|---|
| 70 through-hole | 72 bar |
| 74 through-hole | 76 through-hole |
| 78 bracket | 80 washer |
| 82 torsion spring | 84 lower loop |
| 86 collar bolt | 88 nut |
| 90 lock washer | 92 upper loop |
| 94 hook | 96 spur gear |
| 98 torsion spring | 100 bolts |
| 102 lock washers | 104 through-holes |
| 106 collar bolt | 108 through-hole |
| 110 spur gear | 112 nose |
| 114 shaft | 116 rotating-shaft potentiometer |
| 118 threaded sleeve | 120 through-hole |
| 122 threaded through-hole | 124 nose |
| 126 receptacle | 128 through-hole |
| 130 stops | 132 nut |
| 134 lock washer | 136 cap |
| 138 toroidal gasket | 140 3-conductor wire |
| 142 gasket | 144 gasket |
| 146 constant-potential wire | 148 constant-potential terminal |
| 150 variable-potential wire | 152 variable-potential terminal |
| 154 ground-potential wire | 156 ground-potential terminal |
| 158 foot plate | 160 grillwork |
| 162 lip | 164 lip |
| 166 depression | 168 depression |
| 170 depression | 172 depression |
| 174 bolt | 176 through-hole |
| 178 through-hole | 180 through-hole |
| 182 lock washer | 184 nut |
| 186 through-hole | 188 bracket |
| 190 classroom floor | 192 scuff plate |
| 194 belted rollers | |

DESCRIPTION-ALL FIGURES

FIGS. 1A through 1D, when placed adjacent to one another, constitute an exploded view of the embodiment.

Figure 1A:
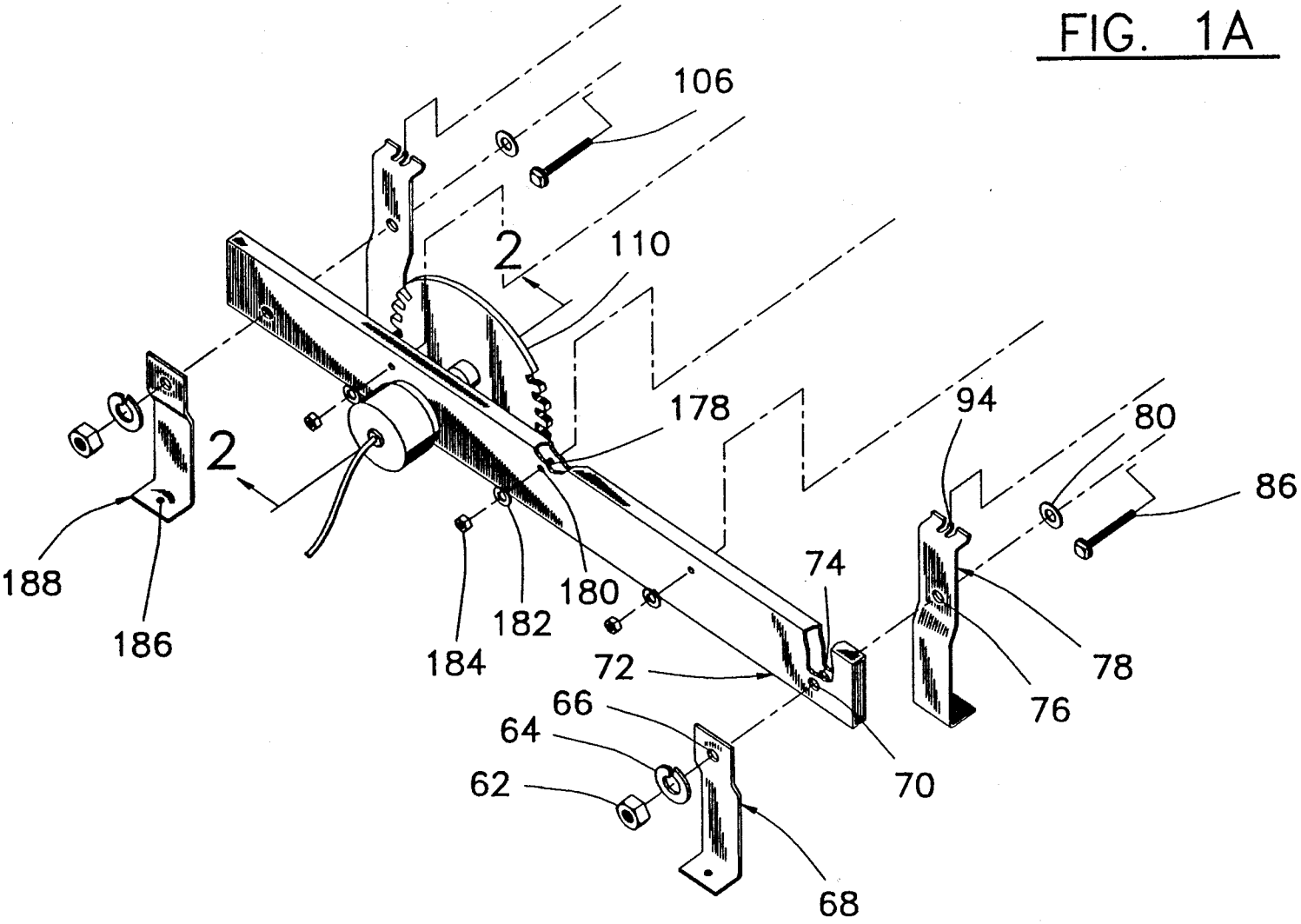
Figure 1B:
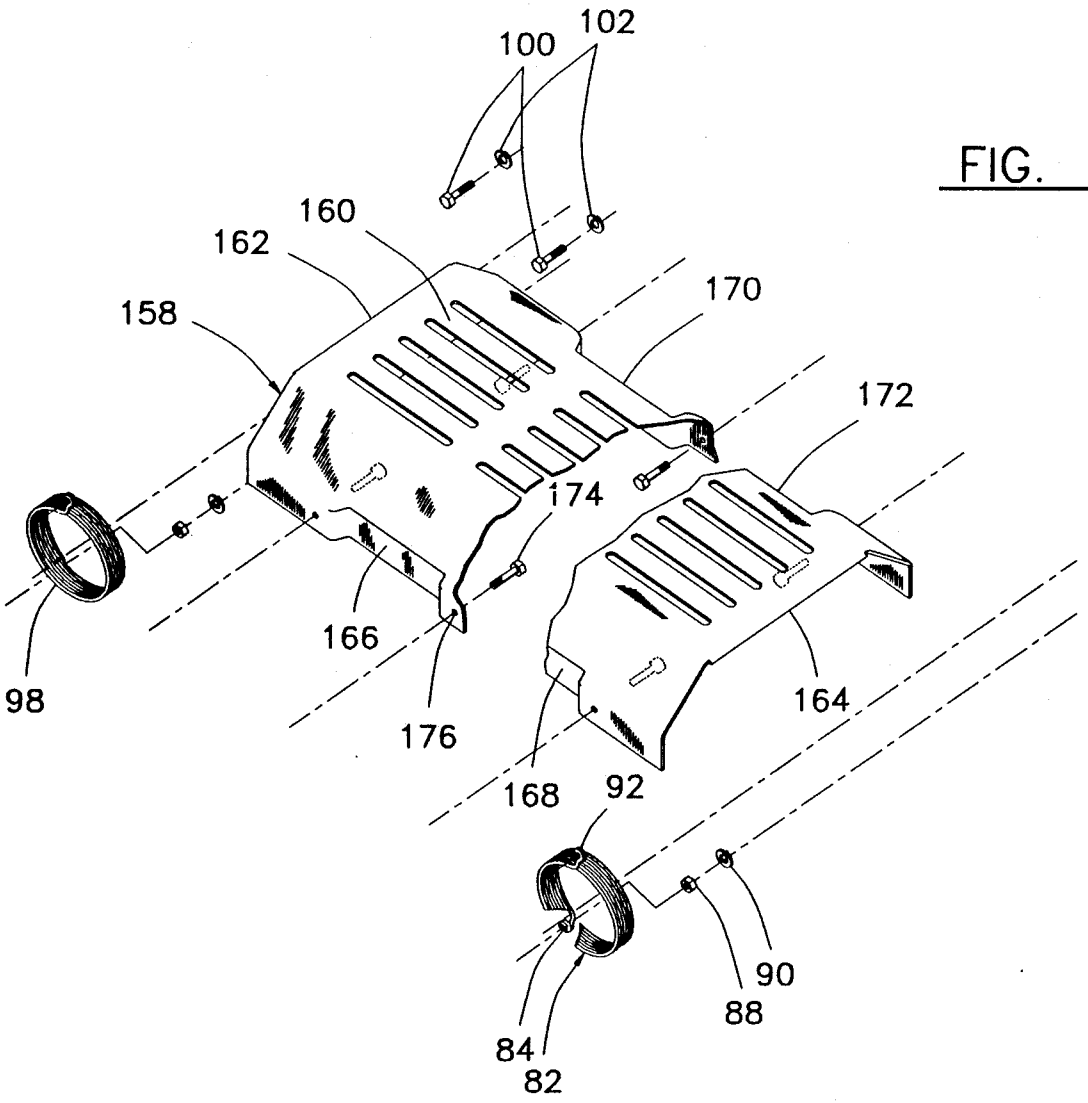
Figure 1C:
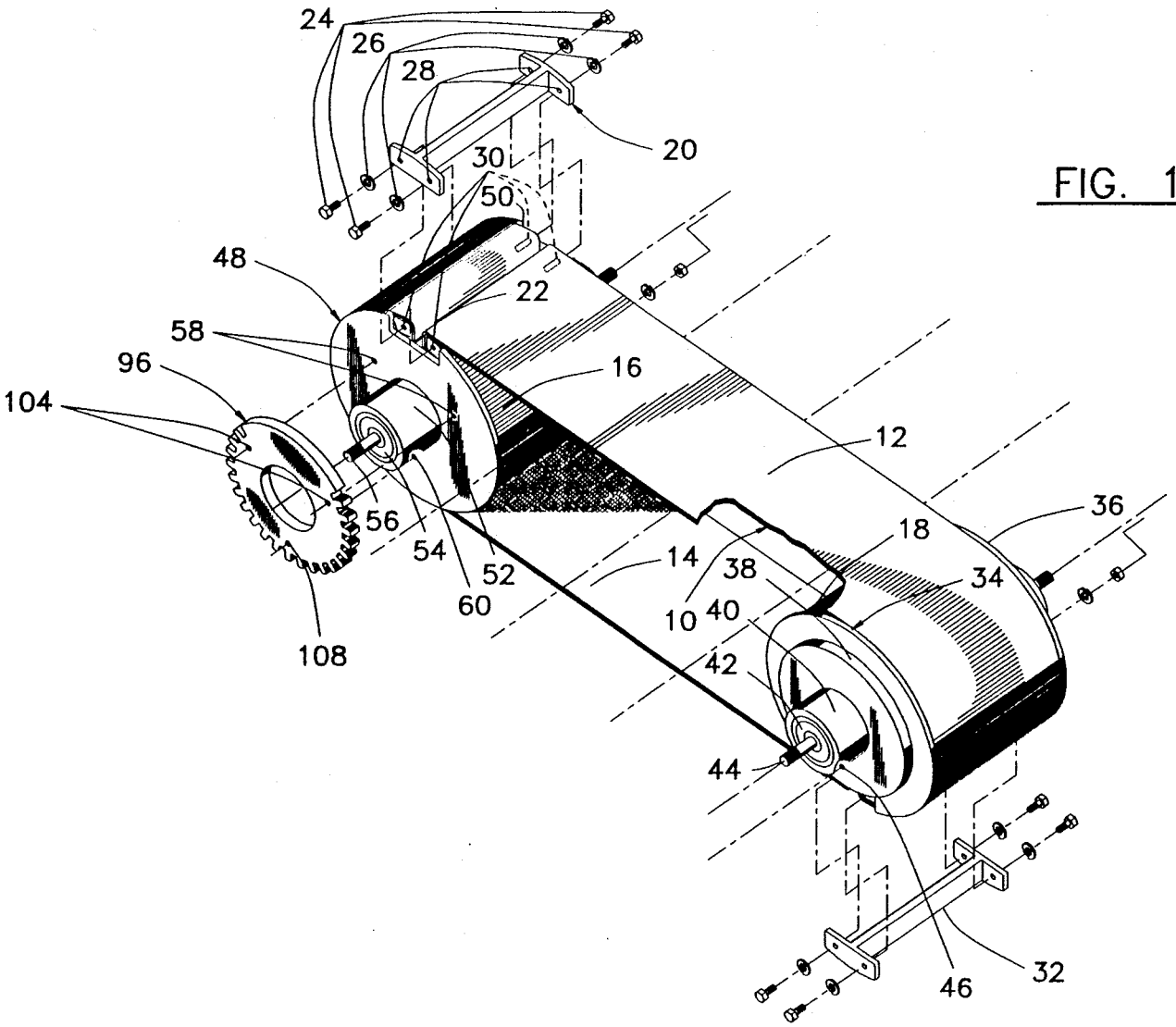
Figure 1D:
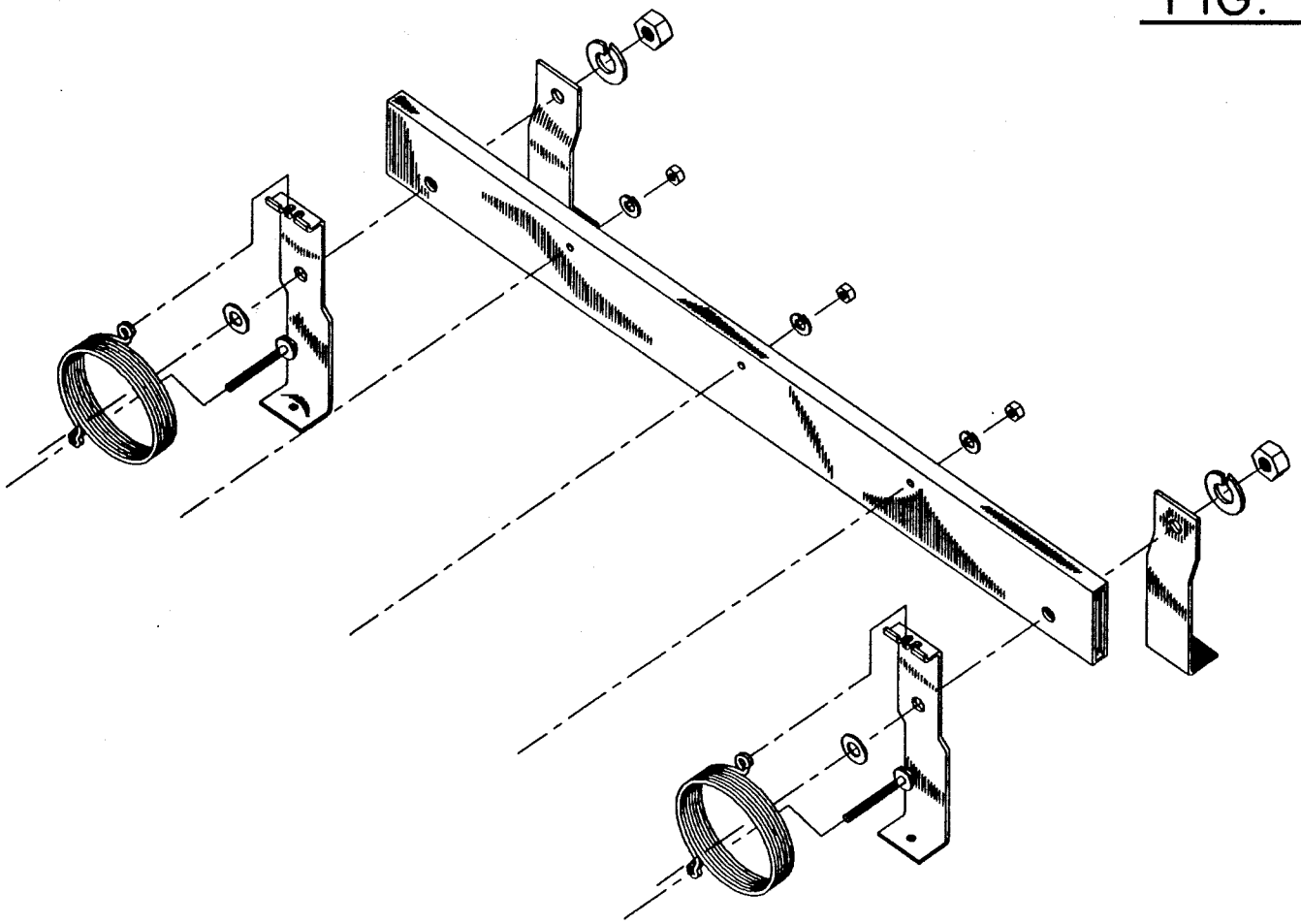

Belt 10 in FIG. 1C consists of rubberlike outer-layer 12 joined to fabric inner-layer 14. Belt 10 is about 183 cm (about 6 feet) long and about 15 cm (about half a foot) wide. It should be strong enough to withstand pressure from a woman standing on it in shoes with high, slim heels.

Belt 10 is mounted on drums 16 and 18. Both of these drums have about 20 cm (about 8 in.) outer-diameters.

Clamp 20 may be positioned in trench 22 by drawing each bolt 24 through each associated lock washer 26, each associated through-hole 28 in clamp 20, and screwing each bolt 24 into each associated tapped hole 30 in the associated face of drum 16.

Clamp 32 is secured similarly.

Drum 18 is mounted on side plates 34 and 36.

Side plate 34 has nose 38 and smaller nose 40, which is mounted on roller bearing 42, which is mounted on axil 44, which is threaded at both ends. Tapped hole 46 is cut into nose 38.

Side plate 34 and its vicinity-nose 38, nose 40, roller bearing 42, the left end of axil 44, and tapped hole 46-constitute the mirror image of side plate 36 and its vicinity.

Drum 16 is mounted on side plates 48 and 50.

Side plate 48 has nose 52, which is mounted on roller bearing 54, which is mounted on axil 56, which is threaded at both ends. Tapped holes 58 and tapped hole 60 are cut into side plate 48.

Side plate 34 and its vicinity except tapped hole 46-both rotated 180° about axil 44-along with tapped hole 46 frozen in place during the rotation constitute the mirror image of side plate 50 and its vicinity.

Lock washer 64, bracket 68, bar 72, bracket 78, and washer 80-all in FIG. 1A-may be clamped together by drawing the left threaded-end of axil 44 through torsion spring 82 in FIG. 1B, washer 80, through-hole 76 in bracket 78, through-hole 74 in the right side of bar 72, through-hole 70 in the left side of bar 72, through-hole 66 in bracket 68, lock washer 64, and screwing nut 62 onto the left threaded-end of axial 44.

Lower loop 84 of torsion spring 82 may be secured on the left end of collar bolt 86 in FIG. 1A by drawing collar bolt 86 through lower loop 84, screwing nut 88 onto collar bolt 86, drawing collar bolt 86 through lock washer 90, and screwing collar bolt 86 into tapped hole 46 until lock washer 90 is compressed between nut 88 and nose 38.

Upper loop 92 of torsion spring 82 may be secured to bracket 78 by hooking upper loop 92 onto hook 94 of the same bracket.

The far left corner of the embodiment may be assembled similarly, but with two exceptions. First, the left end of axil 56 may be drawn through spur gear 96 before being drawn through torsion spring 98 in FIG. 1B. Second, spur gear 96 may be secured to side plate 48 by (a) screwing each bolt 100 in FIG. 1B into each associated tapped hole 58 after drawing each bolt 100 through each associated lock washer 102 and through-hole 104 in spur gear 96, and (b) drawing collar bolt 106 in FIG. 1A through through-hole 108 in spur gear 96 before screwing collar bolt 106 into tapped hole 60.

Both right corners of the embodiment are mirror images of its near left corner.

If the embodiment were fully assembled, spur gear 96 would be in mesh with spur gear 110 in FIG. 1A.

Figure 2:
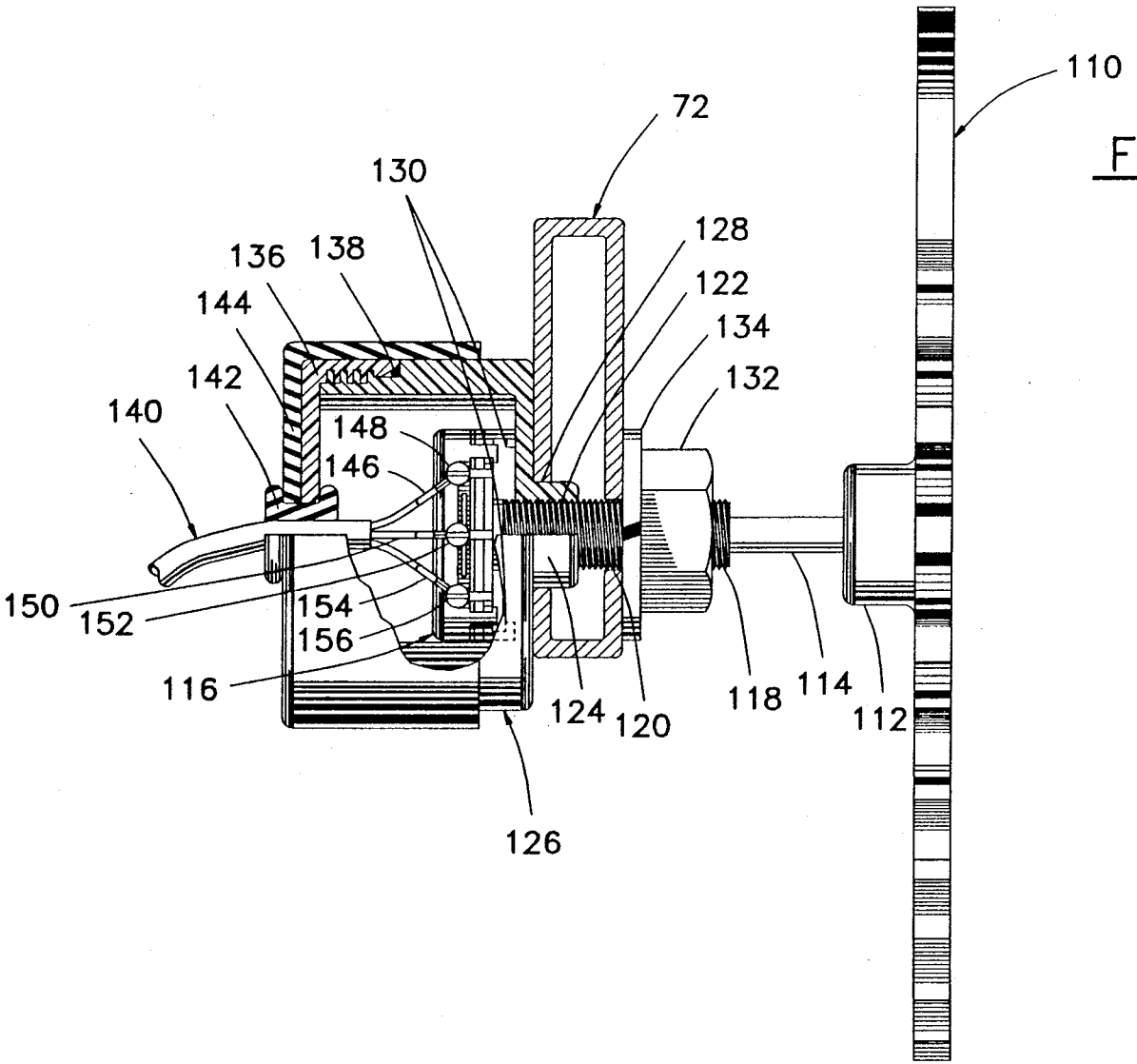
FIG. 2 is a view in detail of the portion indicated by section lines 2—2 in FIG. 1A.

FIG. 2 is a view in detail of the portion indicated by section lines 2—2 in FIG. 1A.

Spur gear 110 in FIG. 2 with nose 112 is mounted on shaft 114 of rotating-shaft potentiometer 116. Shaft 114 is mounted in threaded sleeve 118 of potentiometer 116. Threaded sleeve 118 is mounted in through-hole 120 in the right side of bar 72 and tapped through-hole 122 in nose 124 of receptacle 126. Nose 124 is mounted in through-hole 128 in the left side of bar 72.

Stops 130 on rotating-shaft potentiometer 116, receptacle 126, and bar 72 are clamped together by (a) screwing potentiometer 116 into tapped through-hole 122 until stops 130 are flush against the inner wall of receptacle 126, and (b) screwing nut 132 on threaded sleeve 118 until lock washer 134 is compressed between nut 132 and the right outer face of bar 72.

The tapped through-hole 122/threaded sleeve 118 interface may be caulked.

Cap 136 is screwed onto receptacle 126 so that the former, the latter, and toroidal gasket 138 are firmly sandwiched together.

3-conductor wire 140 is shown running through gasket 142—mounted in gasket 144 and cap 136—and into receptacle 126.

The three wires in 3-conductor wire 140 are constant-potential wire 146, variable-potential wire 150, and ground-potential wire 154. Constant-potential wire 146 runs from a source at constant potential (not shown) to constant-potential terminal 148. Variable-potential wire 150 runs from variable-potential terminal 152 to hardware for real-time acquisition of data (not shown). Ground-potential wire 154 runs from ground-potential terminal 156 to ground (not shown).

Foot plate 158 in FIG. 1B has grillwork 160; lips 162 and 164; and depressions 166, 168, 170, and 172.

The left side of foot plate 158 may be bolted to the right side of bar 72 by drawing bolt 174 through through-hole 176 in the left side of foot plate 158, through-hole 178 in the right side of bar 72, through-hole 180 in the left side of bar 72, lock washer 182, and screwing nut 184 onto bolt 174.

The unlabeled bolts in FIG. 1B may be fastened similarly so that both sides of foot plate 158 may be securely bolted.

Every bracket in the embodiment has a through-hole in its foot similar to through-hole 186 in the foot of bracket 188 in FIG. 1A.

Figure 3:
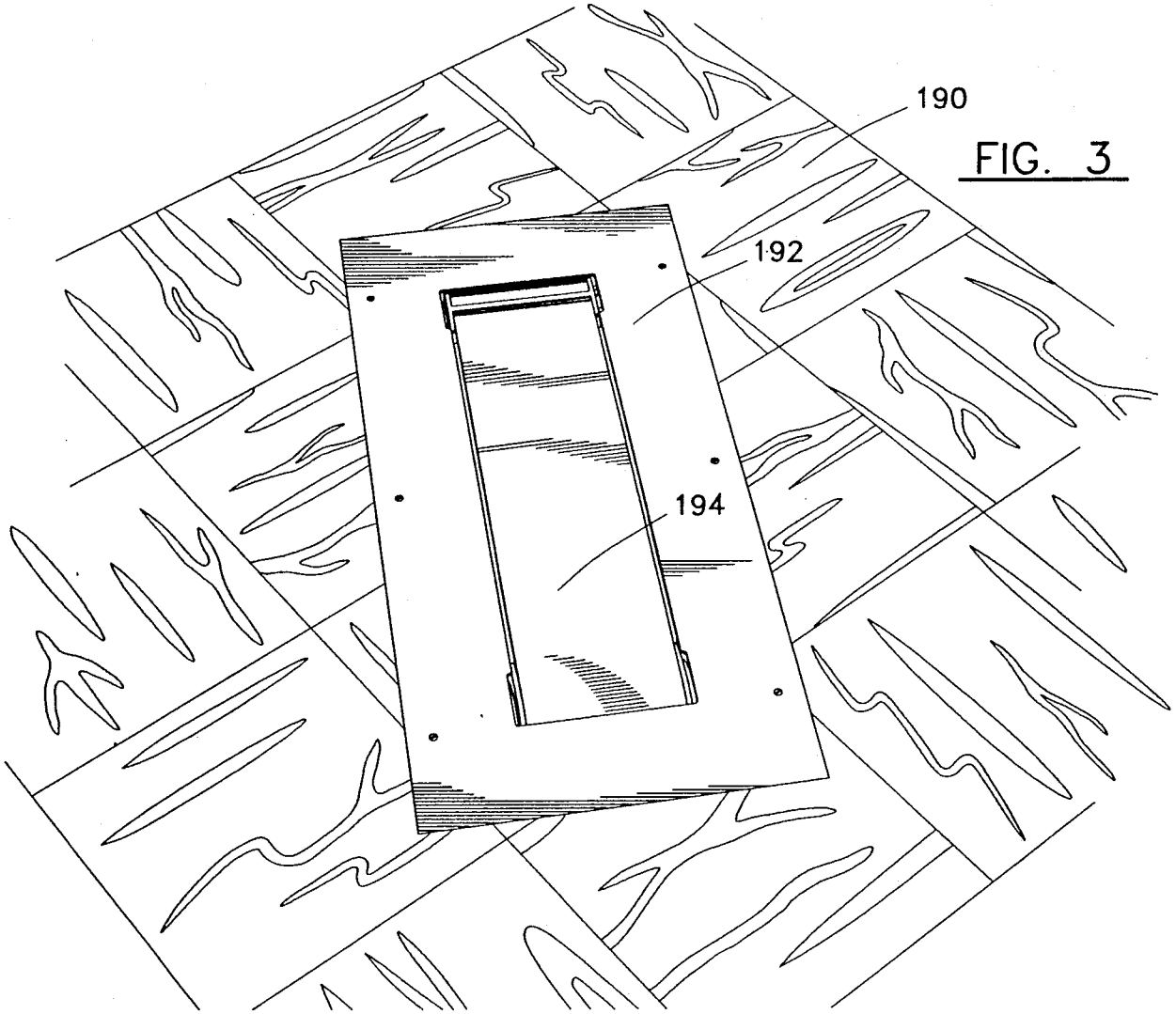
FIG. 3 is a perspective view of the embodiment as it might be seen by a student standing on a classroom floor after pushing aside his chair.

FIG. 3 is a perspective view of the embodiment as it might be seen by a student standing on a classroom floor after pushing aside his chair.

In FIG. 3, scuff plate 192 is an interface between classroom floor 190 and belted rollers 194.

The invention should be made of components that can withstand vibration and moisture.

OPERATION-ALL FIGURES

The embodiment is a potentiometer.

Through-holes similar to through-hole 186 would serve to bolt the embodiment to a classroom subfloor just below wherever a student would sit. After filling a classroom with enough replicas of the embodiment, and after laying the wiring, a classroom floor comparable to those found in computer rooms would be assembled to stand about 23 cm (about 9 in.) above a subfloor so that for each replica of the embodiment, most of the exposed surfaces of belted rollers 194 would be flush with classroom floor 190, as depicted in FIG. 3.

A student sitting in a chair with one foot on belt 10 would slide it forward along foot plate 158 with his foot whenever he would be dissatisfied with a portion of instruction. The greater his dissatisfaction, the farther he would move belt 10.

For ergonomic purposes, the embodiment would be oriented above a classroom subfloor at an angle with respect to a user's line of sight during instruction (in the direction of a black board, for example).

If each replica of the embodiment were properly connected to a system for real-time acquisition of data, an instructor viewing a monitor could see how each of his students understands his instruction in real time.

If a student were to move belt 10 forward, drums 16 and 18 would rotate because (a) they would be clamped to belt 10 with clamps 20 and 32, respectively, and (b) drums 16 and 18 would be mounted on side plates which would be mounted on roller bearings.

Consequently, side plate 48 would rotate, and so would spur gear 96, because they would be bolted together.

Since spur gears 96 and 110 would be in mesh, and since spur gear 110 would be mounted on shaft 114 of rotating-shaft potentiometer 116, moving belt 10 forward would result in the variation of a potential at variable-potential terminal 152.

Since terminal 152 would be connected to computer hardware for real-time acquisition of data—with variable-potential wire 150, the potential at each terminal 152 in an array of replicas of the embodiment—corresponding to each student's satisfaction with instruction—would be displayed in real time on a monitor in the form of a bar graph, for example. In such a bar graph, the height of each bar would correspond to the potential at each variable-potential terminal 152 in each replica of the embodiment, and would rise and fall in real time with the potential at each terminal 152.

Receptacle 126 and cap 136 would serve to protect rotating-shaft potentiometer 116 from moisture and a workman's tools.

Washer 80 would serve as a spacer between bracket 78 and roller bearing 42 lest the former rub against the latter. Washer 80's three unlabeled counterparts would serve similarly.

Torsion spring 82, torsion spring 98, and their two unlabeled counterparts would serve to return the embodiment to a position of static equilibrium.

Foot plate 158 would serve as a structural support to anyone walking over the embodiment, as well as a user's footrest.

Grillwork 160 on foot plate 158 would serve to expose the underside of lower layer 14 of belt 10 to circulating air (possibly from hot air ducts discharging under a classroom floor), and hence would serve to hasten lower layer 14's drying if it were to get wet.

Grillwork 160 would preferably be a series of parallel slits cut so that the length of grillwork edge running transverse to the direction of motion of belt 10 would be minimized to minimize friction with its inner layer 14. Moreover, the amount of friction between fabric inner-layer 14 and foot plate 158 would be acceptable if the latter were shaped from a plate of steel alloy, for example.

Belt 10 could be rotated 180° if the portion of its inner layer 14 in contact with foot plate 158 were to ware out before the adjacent portion of belt 10's outer layer 12.

The upper surfaces of lips 162 and 164 slope downwards smoothly lest inner-layer 14 of belt 10 snag on these lips.

Soapy water, melting snow from a student's boots, etc. could cascade along depressions 166, 168, 170, and 172; onto a classroom subfloor; and into a drain lest dirty residue build up readily along the sides of foot plate 158.

Scuff plate 192 would serve to protect classroom floor 190 from abrasion and scuff marks, and would be removed for cleaning a classroom subfloor and maintaining the embodiment.

Laboratory Technologies Corporation of Wilmington, Mass. sells versions of Labtech Notebook, software for real-time acquisition of data and real-time control, for the IBM PC, XT, AT, PS/2, and compatible computers. No programming is required to use Labtech Notebook because it is icon and menu driven. Comparable software is sold elsewhere.

Advantech Co. Ltd. of San Jose, Calif. sells the PCL-718 High Performance Data Acquisition Card, a computer-hardware device for real-time acquisition of data and real-time control. The PCL-718 is compatible with the above version of Labtech Notebook, and designed to be installed in an expansion slot in any of the above computers. Comparable hardware compatible with Labtech Notebook is sold elsewhere.

An instructor, for example, could load Labtech Notebook into an IBM-compatible computer with six empty expansion slots, install a PCL-718 card in each slot, and use the aforementioned bar-graph display to monitor an array of up to 96 replicas of the embodiment (each card could be used to monitor up to 16 replicas).

As Labtech Notebook is used for real-time control as well as for real-time acquisition of data, an instructor could use Labtech Notebook or comparable software, and compatible hardware, to set a classroom's lights to flicker gently whenever a threshold of dissatisfaction would be reached or exceeded.

Since the embodiment would be subject to vibration, it would be made with lock washers and other parts that withstand vibration.

Moreover, since the embodiment would be subject to moisture, it would be assembled with caulk and parts that remain water resistant while sustaining wear due to vibration.

CONCLUSION, RAMIFICATIONS, AND SCOPE

While objects (a)-instantaneity, (b)-simultaneity, and (c)-continuity-follow primarily from the nature of real-time acquisition of data, object (d)-convenience-follows primarily from the nature of the embodiment.

Justifications for object (d) include the facts that:

using one's foot to register one's satisfaction with instruction would be more discreet and less tiresome than raising one's hand;

because a student would use his foot to register his satisfaction with instruction, his hands could be free to take notes and/or turn pages in a book and/or attract attention to ask a question or make a point;

with token practice, the embodiment could be used quietly lest others in a classroom be disturbed;

the embodiment could be readily scaled down for use by small children;

the embodiment would be a minimal hindrance to maintenance people sweeping or mopping a classroom floor; and neither instructor nor student would need special training to use the system for electronic gauging of classroom satisfaction described above.

Although the above description involves many specificities, these should not be construed as limitations on the scope of the invention, but rather as an exemplification of one of its preferred embodiments. Many other variations are possible. For example, foot plate 158 could be replaced with rollers, rotating-shaft potentiometer 116 and its protective vicinity could be replaced with a naked—albeit water and shock resistant—rotating-shaft potentiometer, shaft 114 of rotating-shaft potentiometer 116 could be driven with a belt, the embodiment's torsion springs could be secured within its rollers, and clamps 20, 32, and their vicinities could be replaced with bolts and lock washers for securing grommets in belt 10 to drums 16 and 18.

Accordingly, the scope of the invention should not be based on a single embodiment, but on the appended claims and their legal equivalents.

I claim:

1. A belted-roller potentiometer, comprising:

(a) a belted-roller treadmill, further comprising a belt around at least two rollers, and means for causing said rollers to recoil to a state of static equilibrium;

(b) a rotating shaft potentiometer, further comprising a rotating shaft joined to a rotating potentiometer; and (c) means for controllably coupling rotational energy from at least one roller of said belted-roller treadmill to the rotating shaft of said rotating-shaft potentiometer so as to vary the electrical potential of said rotating shaft potentiometer.

2. The belted-roller potentiometer of claim 1 wherein said belted-roller treadmill has a foot plate with grillwork thereon so that drying of a wet portion of the belt in contact with said grillwork may be accelerated due to exposure of said portion to circulating air in said grillwork.

3. The belted-roller potentiometer of claim 1 wherein said belted-roller treadmill has a foot plate with depressions along its sides so that runoff from a classroom floor may cascade along said depressions and into a drain lest dirty residue build up readily along said sides of said foot plate.

* * * * *